US006113656A

United States Patent [19]

Kimbrell

[11] Patent Number: 6,113,656

[45] Date of Patent: Sep. 5, 2000

[54] METHOD OF DYEING LOW PILL POLYESTER

[75] Inventor: William C. Kimbrell, Spartanburg, S.C.

[73] Assignee: Milliken & Company, Spartanburg, S.C.

[21] Appl. No.: 08/373,721

[22] Filed: Jan. 17, 1995

[51] Int. Cl.[7] ..... D06P 1/651; D06P 1/607; D06P 1/613; D06P 3/54

[52] U.S. Cl. ..... 8/541; 8/552; 8/576; 8/594; 8/597; 8/604; 8/609; 8/611; 8/922; 8/930; 8/907; 8/908; 8/580

[58] Field of Search ..... 8/495, 541, 532, 8/552, 576, 580, 594, 597, 604, 609, 611, 613, 922, 930, 907, 908, 602

[56] References Cited

U.S. PATENT DOCUMENTS

| | | | |
|---|---|---|---|
| 3,432,250 | 3/1969 | Miller et al. | 8/29 |
| 3,595,813 | 7/1971 | Hartgrove, Jr. | 260/2 |
| 3,627,475 | 12/1971 | Baumann | 8/54 |
| 3,773,463 | 11/1973 | Cohen et al. | 8/18 |
| 3,834,868 | 9/1974 | Tatsuoka et al. | 8/130.1 |
| 3,925,009 | 12/1975 | Rutledge et al. | 8/115.7 |
| 4,103,051 | 7/1978 | Farmer | 427/394 |
| 4,328,220 | 5/1982 | Abel et al. | 424/226 |
| 4,655,786 | 4/1987 | Navratil et al. | 8/475 |
| 4,715,863 | 12/1987 | Navratil et al. | 8/440 |
| 4,880,430 | 11/1989 | Schleusener | 8/188 |
| 5,300,626 | 4/1994 | Jehl et al. | 528/274 |
| 5,306,242 | 4/1994 | Nichols et al. | 252/38 |
| 5,310,424 | 5/1994 | Taylor | 8/190 |

FOREIGN PATENT DOCUMENTS

| | | |
|---|---|---|
| 021887 | 10/1984 | European Pat. Off. . |
| 0382138 | 8/1990 | European Pat. Off. . |
| 1156930 | 5/1958 | France . |
| 2313411 | 12/1976 | France . |
| 2517374 | 6/1975 | Germany . |
| 1060623 | 3/1967 | United Kingdom . |

*Primary Examiner*—Margaret Einsmann
*Attorney, Agent, or Firm*—Terry T. Moyer; Timothy J. Monahan

[57] ABSTRACT

A method for exhaust dyeing a polyester or polyester blend textile article with a disperse dye is provided whereby the article is first treated with an aliphatic amine to reduce the tensile strength of the polyester fibers, followed by dyeing the fabric in a bath containing from 1.0 to 3.0 weight percent based on the weight of the fabric, of a compound selected from the group consisting of:

(a) $C_8$–$C_{16}$ aliphatic fatty acid ethoxylates having from 5 to 15 ethylene oxide residues;

(b) $C_8$–$C_{16}$ alcohol ethoxylates having from 5 to 15 ethylene oxide residues; and (c) $C_8$–$C_{16}$ aliphatic amine ethoxylates having from 5 to 15 ethylene oxide residues, to achieve a spot free, level dyed fabric, with reduced pilling tendencies.

20 Claims, No Drawings

METHOD OF DYEING LOW PILL POLYESTER

BACKGROUND OF THE INVENTION

This invention is directed to a process for uniformly dyeing polyester, which has been previously treated with an aliphatic amine to reduce its tendency to pill.

Treatment of polyester fiber with an aliphatic amine to reduce pilling in textile articles is disclosed in Farmer, U.S. Pat. No. 4,103,051. In a typical application, an undyed textile fabric made from spun polyester yarn is treated with the aliphatic amine to lower the tensile strength of the polyester fibers. Thus, when fibers migrate to the surface of the fabric and become entangled, the fibers are more likely to break away, rather than remain on the surface of the fabric as unsightly pills.

Despite a strong demand on the market for a low pill polyester fabric, the treatment disclosed by Farmer in U.S. Pat. No. 4,103,051 has not found wide use. One of the shortcomings of the prior art treatment is that it has been found to interfere with subsequent dyeing of the fabric. In particular, attempts to exhaust dye the fabric with disperse dyes resulted in spotting and other defects associated with unlevel dyeing.

Therefore, an object of the invention is to provide a process for manufacturing a uniformly dyed, low pill polyester fabric. Another object of the invention is to provide a process wherein the fabric is exhaust dyed with disperse dyes after having been treated with an aliphatic amine. Still another object of the invention is to provide a fabric made according to the aforementioned processes.

Accordingly, a textile article containing polyester fibers can be exhaust dyed with a disperse dye, after the article has been previously treated with an aliphatic amine to reduce the tensile strength of the polyester fibers, by providing in the dye bath at least 1.0 weight percent, based on the weight of the textile article, of a harmonizing compound having the formula: R—X, where R is $C_8$–$C_{16}$ alkyl, alkenyl, alkylphenylene or phenylalkylene and X is a poly(oxyethylene) chain having from 5 to 15 ethylene oxide residues.

The present invention has the advantage of being adaptable to conventional disperse dyeing processes. Further, the process of the present invention may be used with textiles made of 100 percent polyester, as well as blends of polyester fibers and other synthetic and natural fibers.

DETAILED DESCRIPTION OF THE INVETION

Without limiting the scope of the invention, the preferred embodiment and features are hereinafter set forth. Unless otherwise indicated, all parts, percentages and ratios are by weight.

The process of the present invention is adapted for use on polyester fibers, generally defined as a long chain synthetic polymer composed of at least 85 percent by weight of an ester of dihydric alcohol and terephthalic acid. The fibers may be in the form of a textile article, such as a continuous filament, staple, yarn, or a woven, knitted or non-woven fabric. Especially suitable for use are woven and knitted fabrics from spun yarn containing polyester staple fibers.

Also within the scope of the present invention are textiles containing blends of polyester and synthetic and natural fibers. By way of example, polyester may be blended with acetate, acrylic, aramid, nylon, polyolefin, rayon, spandex, triacetate, vinyon, wool, cotton and other cellulosic fibers. In particular, blends of staple polyester and cotton fibers may be used.

The first step of the process is to treat the polyester fibers with an aliphatic amine to reduce their tensile strength thereby reducing pilling. The reduction in tensile strength necessary to achieve significant reductions in pilling depends on the initial tenacity of the fiber: certain fibers, such as Hoechst-Celanese Type 363 Trevira® fibers, are designed ito be low pilling and require relatively small decreases in tensile strength to improve pilling, whereas high tenacity fiber will require a greater relative decrease in tenacity to achieve reduced pilling. For example, tensile strength reductions of from 10 to 80 percent, typically between 20 to 60 percent have been found to achieve the pilling reduction objectives of the process.

The aliphatic amine treatment may be applied according to the teachings in Farmer, U.S. Pat. No. 4,103,051, "Pilling Reduction in Textiles", which is incorporated by reference herein. The aliphatic amine may be applied by padding, dipping, spraynig or immersing the textile in a bath containing the aliphatic amine. Next, the textile or bath containing the textile is heated to promote penetration of the aliphatic amine into the textile fiber. The bath may be aqueous or based on an organic solvent. Advantageously, the treatments performed at a temperature of between 90 and 240° C., preferably between 100 and 180° C.

In a preferred embodiment, the aliphatic amine is exhausted into the fabric in an aqueous bath. The aliphatic amine is only sparingly soluble in the water and is adsorbed onto the surface of the fiber. Upon heating, the aliphatic amine migrates into the fiber.

Treatment of the polyester fiber by exhaustion of the aliphatic amine may be carried out in conventional equipment, such as jet dye apparatus, as is well known in the art. The jet dye equipment is charged with water, the fabric to be treated loaded in, and the aliphatic amine is added. Additionally, caustic is added at the beginning of the cycle to compensate for the softness of the water. It has been found to be advantageous to adjust the pH of the bath to between 10 and 12 at the beginning of the cycle.

The liquor to fabric ratio in the bath ranges from 5:1 to 50:1, preferably 5:1 to 20:1. The aliphatic amine is present in the liquor relative to the weight of the fabric in a ratio of 0.001:1 to 10:1 preferably 0.002:1 to 0.02:1.

Next, the bath is heated, for example, to between 120 and 140° C. for a period of between 15 and 60 minutes. Those with skill in the art will recognize that the treatment time may be reduced by raising the temperature, but equipment capable of handling higher pressures is also required. The treatment has been found to result in approximately 0.1 to 0.5 weight percent add on of the aliphatic amine based on the weight of the fiber. Following the heating cycle, the temperature of the bath is lowered and the fabric is rinsed, first with water and then an aqueous solution of an acid, to neutralize the fabric.

The aliphatic amines suitable for use include those having 10 carbon atoms or greater, preferably 10 to 25 carbon atoms and most preferably 12 to 21 carbon atoms, generally referred to as fatty amines. Specially useful are aliphatic amines having multiple amine functionalities, such as diamines. The aliphatic portion of the amine may contain one or more double bonds and one or more substituent groups which do not interfere with the functionality of the amine, such as a hydroxyl group. By way of example, the following aliphatic amines may be employed: n-decylamine, n-dodecylamine, n-hexadecylamine, 1, 10-decanediamine, 1, 12-dodecanediamine, N-coco-1, 3-propanediamine, N-tallow-1, 3-propanediamine and N-oleyl-1, 3-propanediamine.

The second step of the process is to dye the fabric which has been treated with the aliphatic amine to reduce pilling. It is generally desirable to dye polyester with disperse dyes. The disperse dyes are characterized by being only sparingly soluble in aqueous liquors and they have a relatively high affinity for polyester. Upon heating, disperse dyes diffuse into the polyester fiber. The rate of diffusion is accelerated significantly by dyeing above 120° C. by exhaust techniques and between 190 and 225° C. by thermofixation.

Previous attempts to dye polyester fabric which has been treated with the aliphatic amine to reduce pilling were unsuccessful due to poor leveling effects and spotting. Without being bound to a particular theory, it is believed that upon heating a portion of the unreacted aliphatic amine migrates to the surface of the fiber or is redispersed in the dye bath, causing the disperse dye to precipitate unevenly on the fabric.

The deleterious effect of the anti-pilling treatment on dyeing can be overcome by the introduction of the dye liquor certain harmonizing compounds having an oleophilic component which is $C_8$–$C_{16}$ alkyl, alkenyl, alkylphenylene, phenylalkylene, preferably $C_8$–$C_{16}$ aliphatic, most preferably $C_{10}$–$C_{14}$ aliphatic; and a poly(oxyethylene) chain of from 5 to 15 ethylene oxide residues. The poly(oxyalkylene) chain is covalently bonded to the oleophilic component by an oxy, thio, sulfonyl, imino, —$SO_2$NH—, —C(O)O— or —C(O)NH— group, preferably an oxy, imino, —C(O)O— or —C(O)NH— radical. Synthesis of these compounds is conventional. The harmonizing compounds are provided in the dye liquor at a concentration of at least 1 percent based on the weight of the fabric, preferably at least 1.5 weight percent and most preferably 1.75 weight percent based on the weight of the fabric. Diminishing returns are observed at concentrations above 3.0 weight percent based on the weight of the fabric.

In a preferred embodiment, harmonizing compounds selected from fatty acid, alcohol and amine ethoxylates are employed.

Suitable fatty acid ethoxylates include ethoxylates of $C_8$–$C_{16}$ aliphatic fatty acids, Previous attempts to dye polyester fabric which has been treated with the aliphatic amine to reduce pilling were unsuccessful due to poor leveling effects and spotting. Without being bound to a particular theory, it is believed that upon heating a portion of the unreacted aliphatic amine migrates to the surface of the fiber or is redispersed in the dye bath, causing the disperse dye to precipitate unevenly on the fabric.

The deleterious effect of the anti-pilling treatment on dyeing can be overcome by the introduction of the dye liquor certain harmonizing compounds having an oleophilic component which is $C_8$–$C_{16}$ alkyl, alkenyl, alkylphenylene, phenylalkylene, preferably $C_8$–$C_{16}$ aliphatic, most preferably $C_{10}$–$C_{14}$ aliphatic; and a poly(oxyethylene) chain of from 5 to 15 ethylene oxide residues. The poly(oxyalkylene) chain is covalently bonded to the oleophilic component by an oxy, thio, sulfonyl, imino, —$SO_2$NH—, —C(O)O— or —C(O)NH— group, preferably an oxy, imino, —C(O)O— or —C(O)NH— radical. Synthesis of these compounds is conventional. The harmonizing compounds are provided in the dye liquor at a concentration of at least 1 percent based on the weight of the fabric, preferably at least 1.5 weight percent and most preferably 1.75 weight percent based on the weight of the fabric. Diminishing returns are observed at concentrations above 3.0 weight percent based on the weight of the fabric.

In a preferred embodiment, harmonizing compounds selected from fatty acid, alcohol and amine ethoxylates are employed.

Suitable fatty acid ethoxylates include ethoxylates of $C_8$–$C_{16}$ aliphatic fatty acids, preferably $C_{10}$–$C_{14}$ fatty acids. The acids may be saturated or contain 1, 2 or 3 double bonds usually 0 or 1 double bond. In particular, ethoxylates of coconut oil fatty acids have been found to be useful.

Suitable alcohol ethoxylates include ethoxylates of $C_8$–$C_{16}$ alcohols, including alkylphenols such as octylphenol, preferably ethoxylates of $C_{10}$–$C_{14}$ aliphatic alcohols. As with the fatty acids, the alcohols may contain double bonds. Examples of suitable alcohol ethoxylates include ethoxylates of lauryl alcohol.

Suitable amine ethoxylates include ethoxylates of $C_8$–$C_{16}$ aliphatic amines, especially $C_{10}$–$C_{14}$ aliphatic amines. The aliphatic portion of the amine may contain 1, 2 or 3 double bonds, usually 0 or 1 double bond. Examples of suitable amine ethoxylates include ethoxylates of amines derived from coconut fatty acids, primarily $C_{12}$–$C_{14}$ alky amines.

Those with skill in the art will recognize that the hydrocarbon component of the fatty acids, alcohols and amines can be substituted with, for example, a hydroxyl group, or other substituent which does not interfere with the compound's functioning in the process.

Dyeing with disperse dyes is usually accomplished by exhaust techniques at a pH below 7, preferably at a pH 4.5 to 6.5. The pH is typically lowered by the addition of acetic acid to the aqueous dye bath at the start of the dye cycle. Dyeing may be performed in the same jet dye apparatus as was used for the anti-pilling treatment with the aliphatic amine, after the fabric has been rinsed and the jet dye apparatus drained. First, water is charged to the vessel and the pH is adjusted as described above. The liquor to fabric ratio is in the range of 5:1 to 50:1, preferably 5:1 to 20:1. Next, the previously described harmonizing compound, or mixtures thereof are added to the liquor, along with conventional dyeing auxiliaries. These auxiliaries may include dispersing agents, defoamers, leveling agents, chelating agents and UV absorbers.

Next, the disperse dye is charged to the liquor. Any of a wide range of disperse dyes may be used in the process. By way of example and not limitation, disperse dyes from the classes of azo, anthraquinone, quinoline, methine and xanthene disperse dyes may be used. Depending on the shade desired, from 0.01 to 10 weight percent, based on the weight of the fabric, of the disperse dyes are added to the liquor. Dyeing is accomplished by conventional exhaust dyeing with disperse dyes, such as heating the dye bath to a temperature of about 120 to 140° C. Lower temperatures may be used by adding a carrier to swell the fiber and promote dye penetration, as is well known in the art. Exhaust dyeing of the polyester usually occurs within 15 to 45 minutes for medium energy disperse dyes and 30 to 75 minutes for high energy disperse dyes.

At the end of the dye cycle, the liquor is drained and the fabric is rinsed from 1 to 3 times. One or more of the rinses may include acetic acid to enhance removal of any residual dye.

It is also in the scope of the present invention to treat fabrics made from a blend of polyester and other fiber, such as cotton. For example in the case of polyester/cotton blends, the dye bath may contain a fiber reactive dye for the cotton, thus using a "one-bath" dye process. Alternatively, the fabric may be dyed before or after the polyester is dyed, under conditions suitable for dyeing the other component of the blended fiber.

Polyester/cotton blends, typically 35–65 polyester/cotton are preferably treated with an agent to reduce the tensile strength of the cellulosic fibers. The reduction of the tensile strength of the cellulosic fibers may be accomplished by acid treatment or with a compound which produces an acid upon heating, such as magnesium chloride as disclosed in Davis, Jr. et al, U.S. Pat. No. 5,350,423. Embrittlement, and thus reduction of the tensile strength of cellulosic fibers may also be accomplished as a result of application of a permanent press treatment or other techniques for cross linking the cellulosic fibers. Such techniques are well known in the art and are disclosed in the Kirk-Othmer, *Encyclopedia of Chemical Technology,* 3rd Ed., Vol. 22, pp 769–802 (1983) and *Handbook of Fiber Science and Technology: Chemical Processing of Fibers and Fabrics, Functional Finishes*, ed. Levin et al., Vol. II, Part A (1983). All the aforementioned U.S. patents are incorporated by reference herein.

The treatment to reduce the tensile strength of the cotton is typically applied after the fabric has been dyed, although, the acid treatment may be applied as a pretreatment to application of the aliphatic amine or subsequent thereto but before dyeing the fabric. Treatment of the cellulosic fibers in a polyester/cotton blend is especially helpful for reducing pilling, because both the tensile strength of the polyester and the cotton have been reduced.

The invention may be further understood by reference to the following examples, but the invention is not to be construed as being unduly limited thereby.

"Mullen Burst Strength was tested according to ASTM test method D 3786-89. Briefly, the method involves clamping a specimen of the fabric to be tested over an expandable diaphragm. The diaphragm is expanded by fluid pressure to the point of speciman rupture. The difference between the total pressure required to rupture the specimen and the pressure required to inflate the diaphragm is reported as the bursting strength.

Random Tumble Pilling was tested according to ASTM test method D 3512-82. Briefly, the method involves simulating on a laboratory testing machine the pilling and other changes in surface appearance, such as fuzzing, that occur in normal wear. Fabrics are caused to form typical pills by a random rubbing motion produced by tumbling specimens in a cylindrical test chamber lined with a mildly abrasive material. In order to form pills that resemble those produced in actual wear in appearance and structure, small amounts of short length cotton fiber (gray in color) are added to each test chamber with the specimens. The degree of fabric pilling is evaluated by comparison of the test specimens with visual standards of actual fabrics showing a range of pilling resistance. The observed resistance to pilling is reported on an arbitrary scale ranging fiom 1.0 (severe pilling) to 5.0 (no pilling).

Tear Strength was tested according to ASTM test method D 2261-83. Briefly, the method involves a rectangular specimen, cut in the center of the shorter edge to form two "tongues" which are gripped in the clamps of a recording tensile testing machine and pulled to simulate a rip. The force to continue the tear is calculated from integrator readings as the average of the five highest peaks.

Resistance to Pilling-Elastomeric Pad Method was tested to according to ASTM test method D 3514-81. Briefly, the method involves simulating pilling and other changes in surface appearance that occur in normal wear by using a laboratory testing machine. Fabric samples are washed and dryed, which is followed by controlled rubbing against an elastomeric pad having specially selected mechanical properties. Suitable elastomeric friction pads are available from Milliken Research Corporation, P.O. Box 1927, Department M-415, Spartanburg, S.C., 29304. The degree of fabric pilling is then evaluated against standards on an arbitrary scale ranging from 1.0 (severe pilling) to 5.0 (no pilling)."

EXAMPLE 1 (Control)

The following example shows treatment of a polyester fabric with an aliphatic amine followed by dyeing in a dye bath, without the harmonizing compound of the present invention.

The fabric tested was an interlock knit constructed with 27/1 (cotton count) polyester yarn type K-80 from Hoechst-Celanese, weighing approximately 5.75 ounce per square yard.

One hundred grams of the fabric was placed into a Werner-Mathis J F laboratory dyeing machine. One liter of an aqueous liquor containing 0.75 grams of N-coco-1, 3-propanediamine and 0.5 grams of sodium hydroxide was added to the dyeing machine. The temperature of the bath was increased to 130° C. and held at that temperature for 30 minutes. The bath was then cooled to 70° C. and the liquor was drained. The fabric was then rinsed 3 consecutive times for 2 minutes each with (a) 1 liter of water, (b) 1 liter of water containing 1 percent acetic acid based on the weight of the fabric, and (c) 1 liter of water.

The fabric was left in the dye machine and 800 milliliters of water was added. Next, 100 milliliters of solution A having the following auxiliaries, was added to the liquor, all weight percentages are based on the weight of the fabric (o.w.f.):

1.50 weight percent Milease HPA, a polyester resin dispersion available from Imperial Chemical, Inc. (ICI);

1.50 weight percent (Repel-O-tex QCJ), an ethoxylated polyester dispersion available from Rhone-Poulenc;

0.75 weight percent of an oleic acid 16 mole ethoxylate, as a leveling agent;

1.00 weight percent Millitex Defoamer 908, a mineral oil/anionic surfactant available from Milliken Chemical;

0.50 weight percent acetic acid; and 0.10 weight percent Sequestrene 30A, an EDTA chelating available from Ciba-Geigy.

The liquor was circulated for 5 minutes then 100 milliliters of an aqueous composition containing the following disperse dyes was added to the liquor:

0.2663 weight percent Terasil Yellow BRLF (50 percent paste) (Disperse Blue 27) available from Ciba-Geigy;

0.0614 weight percent Palanil Pink REL (Disperse Red 91) available from BASF; and 0.0454 weight percent Dianix Blue FBLE (Disperse Blue 56) available from Hoechst-Celanese.

The temperature was increased to 130° C. and held for 30 minutes. The temperature was then lowered to 70° and the liquor was drained. The fabric was rinsed 3 times for 2 minutes each with 1 liter of water and removed from the dye machine, dried and heat set by conventional methods.

A tan fabric was obtained, which was covered with large and small spots and showed general unlevel dyeing.

EXAMPLE 2

The following example shows treatment of a polyester fabric with an aliphatic amine followed by dyeing in the presence of the ethoxylated fatty acid according to the present invention.

Example 1 was repeated in all respects, except that 2.00 weight percent, based on the weight of the fabric, of a 10 mole ethoxylate of coconut fatty acid was added to the dye bath liquor prior to adding the dye.

A tan fabric was obtained with no spotting and level dyeing.

The fabric was tested for strength and pilling properties and the results are reported below in Table 1.

TABLE 1

| Test | Untreated Control | Example 2 |
|---|---|---|
| Mullen Burst Strength[1] | 209 lbs. | 90 lbs. |
| Random tumble pilling[2] | | |
| 30 minutes | 1.0 | 4.5 |
| 60 minutes | 1.0 | 5.0 |
| 90 minutes | 1.0 | 4.5 |

[1]Mullen Burst Strength was tested according to ASTM test method D3786-89.
[2]Random tumble pilling was tested according to ASTM test method D 3512. The samples were rated on a scale ranging from 1.0 (severe pilling) to 5.0 (no pilling).

EXAMPLE 3

The following example shows treatment of a woven polyester fabric containing both continuous filament and staple yams, with an aliphatic amine followed by dyeing in the presence of the ethoxylated fatty acid of the present invention.

Example 2 was repeated in all respects except that 0.375 grams of N-coco-1, 3-propanediamine was used for the anti-pilling treatment and the fabric was an oxford weave, weighing 6.8 ounces per square yard, with 75 ends per inch containing 2/150/34 (ply/denier/filament) super Danberry type 667, Dacron® polyester and 2/70/34 Danberry type 56T Dacron® polyester and 48 picks per inch of 12/1 (cotton count) T363 Trevira® polyester.

A tan fabric was obtained with no spotting and level dyeing. It was also tested for tear strength and pilling and the results are shown below in Table 2.

TABLE 2

| Test | Untreated Control | Example 3 |
|---|---|---|
| Tear Strength[3] | | |
| Warp | 14.1 lbs. | 8.5 lbs. |
| Fill | 9.4 lbs. | 3.9 lbs. |
| Random Tumble Pilling | | |
| 30 Min. | 3.0 | 5.0 |
| 60 Min. | 5.0 | 5.0 |
| 90 Min. | 5.0 | 5.0 |
| Pilling - Elastomeric Pad[4] | 1.0 | 5.0 |

[3]Tear strength was tested according to ASTM test method D-2261.
[4]Pilling - with an elastomeric pad was tested according to ASTM test method D-3514.

EXAMPLE 4

The following example shows treatment of a polyester fabric with an aliphatic amine followed by dyeing in the presence of various ethoxylated compounds.

The fabric tested was a 2X1 right hand twill, weighing 6.6 ounces per square yard, having a construction of 70 ends per inch by 55 picks per inch of 2/150/34 type 667 polyester from Hoechst-Celanese Corporation.

The fabric was treated with an aliphatic amine according to the description in Example 1.

Next, the fabric was dyed according to the procedure set forth in Example 2 by first adding the auxiliaries described below, all weight percentages are o.w.f.:

1.00 weight percent Milease HPA (described above);

2.00 weight percent Millitex Defoamer 908 (described above);

1.60 weight percent Leveler 550, a polyester resin dispersion available from Eastman Chemical Company;

1.00 weight percent acetic acid;

0.20 percent Millad 200, a UV absorber available from Milliken Chemical; and 0.10 weight percent Sequestrene 30A (described above).

Additionally, one of the ethoxylated compounds identified in Table 3 below was added to the auxiliaries to test its effect on preventing spotting and unlevel dyeing of the fabric. In this example, the ethoxylated compound being tested comprised 2.00 weight percent, based on the weight of the fabric, in the liquor, except that Run A was a control.

The following dyes were substituted for those described in Example 2 above.

2.3635 weight percent Terasil Yellow 2R (50 weight percent paste) available from Ciba-Geigy;

0.2811 weight percent Intrasil Brilliant Blue BNS (Disperse Blue 60) available from Crompton & Knowles; and 4.5135 weight percent Terasil Blue GLF (50 weight percent paste) (Disperse Blue 27) available from Ciba-Geigy.

After the fabric was dyed, rinsed, dried and heat set, the fabric was rated good, fair or poor, based on the quality of the dyeing, according to the following criteria:

Good—No spotting, level dyeing, first quality;

Fair—Small spots, general level dyeing, marginal quality; and

Poor—Many large and small spots, unlevel dyeing, off quality.

The results are tabulated below in Table 3.

TABLE 3

| Run | Additive | Dye Rating |
|---|---|---|
| A | Control (no additive) | Poor |
| B | Ethoxylated coconut fatty acid (5 EO) | Fair |
| C | Ethoxylated coconut fatty acid (10 EO) | Good |
| D | Ethoxylated coconut fatty acid (15 EO) | Fair |
| E | Ethoxylated tert-octylphenol (10 EO) | Good |
| F | Ethoxylated coconut amine (15 EO) | Fair |
| G | Ethoxylated stearic acid (10 EO) | Poor |
| H | Ethoxylated oleic acid (16 EO) | Poor |

EXAMPLE 5

The following example shows treatment of a polyester fabric with an aliphatic amine followed by dyeing in the presence of various concentrations of the ethoxylated fatty acid of the present invention.

The procedure of Example 4C was repeated in all respects except that the concentration of the ethoxylated coconut fatty acid (10 EO) was decreased down to 0.50 weight percent and 1.00 weight percent, based on the weight of the fabric, for Runs I and J, respectively.

The results are presented in Table 4 below and include ran C from Example 4.

TABLE 4

| Run | Concentration (wt % o.w.f.) | Dye Rating |
|---|---|---|
| I. (Example 5) | 0.50 | Poor |
| J. (Example 5) | 1.00 | Fair |
| C. (Example 4) | 2.00 | Good |

EXAMPLE 6

The following example shows treatment of a polyester/cotton fabric with an aliphatic amine, dyeing in the presence of an ethoxylated fatty acid of the present invention, and last, application of a durable press finish.

Example 2 was repeated except that (1) a 50/50 polyester/cotton interlock knit fabric, weighing 8.5 ounces per yard constructed from 35/1 (cotton count) open end spun polyester/cotton yarn was used, and (2) 1.3 grams of N-coco-1 3-propanediamine, 0.25 grams sodium hydroxide and 0.5 grams of Millitex Defoamer 908 was used during the anti-pilling treatment.

Following heat-setting, the dyed fabric was cut in half, and one of the halves was treated with a conventional durable press (permanent press) treatment as follows. A composition containing 5.0 weight percent of an ethylene-urea resin, 1.25 weight percent of a magnesium chloride catalyst and 1.0 weight percent of a polyethylene emulsion softener was padded on the fabric at 50% wet pickup on the weight of the fabric, dried at 149° C. for 5 minutes and cured at 193° C. for 1 minute.

Both halves of fabric, with and without the durable press treatment, showed good, level dyeing without spotting. The half of fabric which had been treated with the durable press treatment was found to have significantly less pilling as shown in Table 5 below.

TABLE 5

| Test | Untreated/Undyed Control | Example 6 with-durable press treatment | Example 6 with durable press treatment |
|---|---|---|---|
| Mullen Burst | 100 lbs. | 68 lbs. | 42 lbs. |
| Random Tumble Piling | | | |
| 30 Min. | 1.0 | 1.0 | 5.0 |
| 60 Min. | 1.0 | 1.0 | 4.5 |
| 90 Min. | 1.0 | 1.0 | 4.5 |

There are, of course, many alternate embodiments and modifications of the invention, which are intended to be included within the scope of the following claims.

What I claim is:

1. In a method of exhaust dyeing a textile article containing polyester fibers with a disperse dye, wherein the article has been previously treated with an aliphatic amine to reduce the tensile strength of the polyester fibers, the improvement comprising, providing in a dye bath at least 1.0 weight percent, based on the weight of the textile article, of a harmonizing compound selected from the group consisting of:

(a) $C_8$–$C_{16}$ aliphatic fatty acid ethoxylates having from 5 to 15 ethylene oxide residues;

(b) $C_8$–$C_{16}$ alcohol ethoxylates having from 5 to 15 ethylene oxide residues; and (c) $C_8$–$C_{16}$ aliphatic amine ethoxylates having from 5 to 15 ethylene oxide residues.

2. The method of claim 1 wherein the dye bath is heated to a temperature of between 120 and 140° C.

3. The method of claim 1 wherein the textile article is a woven, knit or non-woven fabric.

4. The method of claim 1 wherein the compound is a $C_{10}$–$C_{14}$ fatty acid ethoxylate.

5. The method of claim 4 wherein the dye bath is heated to a temperature of between 120 and 140° C.

6. The method of claim 5 wherein the compound is provided in the dye bath at a concentration of at least 1.5 weight percent, based on the weight of the textile article.

7. The method of claim 1 wherein the compound is provided in the dye bath at a concentration of 1.5 to 3.0 weight percent, based on the weight of the article.

8. The method of claim 7 wherein the textile article is a woven or knit fabric comprising polyester/cellulosic fiber spun yam and the fabric is treated after dyeing to reduce the tensile strength of the cellulosic fiber.

9. The method of claim 8 wherein the treatment applied after dyeing the fabric is a cellulosic fiber cross-linking finish.

10. The method of claim 2 wherein the harmonizing compound is derived from a coconut fatty acid ethoxylate.

11. In a method of exhaust dyeing a textile article containing polyester fibers with a disperse dye, wherein the article has been previously treated with an aliphatic amine to reduce the tensile strength of the polyester fibers, the improvement comprising, providing in a dye bath at least 1.0 weight percent, based on the weight of the textile article, a harmonizing compound having an oleophilic component selected from the group consisting of $C_8$–$C_{16}$ alkyl, alkenyl, alkylphenylene and phenylalkylene, which is covalently bonded to a poly(oxyalkylene) chain having from 5 to 15 ethylene oxide residues, by a radical selected from the group consisting of oxy, thio, sulfonyl, imino, —$SO_2$NH—, —C(O)O— and —C(O)NH— radicals.

12. The method of claim 11 wherein the dye bath is heated to a temperature of between 120 and 140° C.

13. The method of claim 12 wherein the textile article is a woven, knit or non-woven fabric.

14. The method of claim 13 wherein the oleophilic component is $C_{10}$–$C_{14}$ alkyl or alkenyl.

15. The method of claim 14 wherein the compound is provided in the dye bath at a concentration of at least 1.5 weight percent, based on the weight of the textile article.

16. The product of the process of claim 1.

17. The product of the process of claim 4.

18. The product of the process of claim 9.

19. The product of the process of claim 11.

20. The product of the process of claim 15.

* * * * *